US010415385B2

(12) United States Patent
Kraemer et al.

(10) Patent No.: US 10,415,385 B2
(45) Date of Patent: Sep. 17, 2019

(54) PICK, IN PARTICULAR A ROUND-SHANK PICK

(71) Applicant: Betek GmbH & Co. KG, Aichhalden (DE)

(72) Inventors: Ulrich Kraemer, Wolfach (DE); Heiko Friederichs, Aichhalden (DE); Christoph Haberstroh, Aichhalden (DE); Thomas Allgaier, Schramberg-Sulgen (DE)

(73) Assignee: Betek GmbH & Co. KG, Aichhalden (DE)

( * ) Notice: Subject to any disclaimer, the term of this patent is extended or adjusted under 35 U.S.C. 154(b) by 0 days.

(21) Appl. No.: 15/653,890

(22) Filed: Jul. 19, 2017

(65) Prior Publication Data

US 2018/0003051 A1 Jan. 4, 2018

Related U.S. Application Data

(63) Continuation of application No. PCT/EP2016/051342, filed on Jan. 22, 2016.

(30) Foreign Application Priority Data

Jan. 26, 2015 (DE) ..... 10 2015 101 063

(51) Int. Cl.

| | |
|---|---|
| ***E21C 35/18*** | (2006.01) |
| ***E21C 35/183*** | (2006.01) |
| ***E21B 10/46*** | (2006.01) |
| *E21C 35/19* | (2006.01) |
| *E21C 35/197* | (2006.01) |

(Continued)

(52) U.S. Cl.

CPC ..... *E21C 35/183* (2013.01); *E21B 10/46* (2013.01); *E21C 35/19* (2013.01); *E21C 35/197* (2013.01);

(Continued)

(58) Field of Classification Search

CPC ..... E21C 35/18; E21C 35/183

See application file for complete search history.

(56) References Cited

U.S. PATENT DOCUMENTS 4,682,987 A * 7/1987 Brady ..... B24D 3/007 427/376.3

4,711,503 A 12/1987 Berchem et al.

(Continued)

FOREIGN PATENT DOCUMENTS

DE 35 31 787 C1 6/1986

DE 35 19 101 A1 12/1986

(Continued)

OTHER PUBLICATIONS

German Office Action (Application No. 10 2015 101 063.1) dated Nov. 10, 2015.

(Continued)

*Primary Examiner* — Janine M Kreck

(74) *Attorney, Agent, or Firm* — Burr & Brown, PLLC

(57) ABSTRACT

A round-shank pick, comprising a pick head and a pick shank, the pick head including a base part and a cutting element, which is connected to the base part and is composed of a hard material, in particular hard metal, wherein the base part has a wear-resistant layer on the outer surface thereof at the connection to the cutting element, which wear-resistant layer covers at least one segment of the outer surface of the base part facing the cutting element and wherein an end face of the wear-resistant layer facing the cutting element is covered by the cutting element. The base part has an axially oriented cut-out for receiving a fastening segment of the cutting element, the base part has a counter surface facing the cutting element and extending around the cut-out, and the counter surface and the end face of the wear-resistant layer form a continuous flat surface.

18 Claims, 6 Drawing Sheets

(52) U.S. Cl.
CPC ..... *E21C 2035/1806* (2013.01); *E21C 2035/1813* (2013.01)

(56) References Cited

U.S. PATENT DOCUMENTS

| | | | | |
|---|---|---|---|---|
| 4,944,559 | A * | 7/1990 | Sionnet | E21C 35/183 299/105 |
| 5,702,160 | A * | 12/1997 | Levankovskii | E21C 35/183 299/111 |
| 6,758,530 | B2 * | 7/2004 | Sollami | B28D 1/188 299/104 |
| 2008/0106138 | A1 * | 5/2008 | Yang | B25D 17/02 299/104 |

FOREIGN PATENT DOCUMENTS

| | | | |
|---|---|---|---|
| DE | 3519101 | A1 | 12/1986 |
| DE | 90 16 655 | U1 | 2/1991 |
| DE | 40 39 217 | A1 | 6/1992 |
| EP | 0 412 287 | A2 | 2/1991 |
| EP | 0412287 | A2 | 2/1991 |
| EP | 2789794 | A1 | 10/2014 |
| WO | 2009/072958 | A1 | 6/2009 |

OTHER PUBLICATIONS

International Search Report and Written Opinion (Application No. PCT/EP2016/051342) dated May 11, 2016.
European Office Action (Application No. 16 701 457.0) dated Jun. 13, 2018 (with partial machine translation).
Chinese Office Action (Application No. 201680018688.3) dated Aug. 7, 2018 (with English translation).
Japanese Office Action (Application No. 2017-539417) dated Sep. 10, 2018 (with English translation).
Indian Office Action (and English translation) from an Indian patent application (India Application No. 201747029635) dated Jul. 29, 2019.

* cited by examiner

PICK, IN PARTICULAR A ROUND-SHANK PICK

CROSS REFERENCE TO RELATED APPLICATIONS

This application is a continuation of International Application No. PCT/EP2016/051342 filed Jan. 22, 2016, which designated the United States, and claims the benefit under 35 USC § 119(a)-(d) of German Application No. 10 2015 101 063.1 filed Jan. 26, 2015, the entireties of which are incorporated herein by reference.

FIELD OF THE INVENTION

The present invention relates to a chisel, in particular, a round-shank chisel, having a chisel head and having a chisel shank, wherein the chisel head is formed at least from a base part and from a cutting element which is connected to the base part and which is composed of a hard material, in particular of hard metal, wherein the base part has, adjacent to the cutting element, a wear-resistant layer on its outer face, which wear-resistant layer covers at least one section, facing toward the cutting element, of the outer face of the base part, and wherein a front face, facing toward the cutting element, of the wear-resistant layer is covered by the cutting element.

The present invention furthermore relates to a chisel, in particular, a round-shank chisel, having a chisel head and having a chisel shank, wherein the chisel head is formed at least from a base part and from a cutting element which is connected to the base part and which is composed of a hard material, in particular of hard metal, wherein the cutting element lies indirectly or directly with a bearing face at least regionally on the base part, and wherein the base part has, adjacent to the cutting element, a wear-resistant layer on its outer face, which wear-resistant layer covers at least one section, facing toward the cutting element, of the outer face of the base part.

The present invention also relates to a method for coating at least a section of an outer face of a chisel head of a chisel, in particular of a round-shank chisel, having a wear-resistant layer, wherein, in a second method step, a cutting element is brazed onto a face, facing toward the cutting element, of the wear-resistant layer and a front counterpart face of a base part of the chisel head.

The present invention furthermore relates to a method for producing a chisel head of a chisel, in particular of a round-shank chisel, wherein the chisel head has a base part with a cutting element attached to the front end of the base part, wherein a wear-resistant layer is applied, so as to join the cutting element, to an outer face of the base part, and wherein a front face, facing toward the cutting element, of the wear-resistant layer is at least regionally covered by the cutting element.

BACKGROUND OF THE INVENTION

A chisel of this type is known from DE 90 16 655 U1. The chisel described in the document has a main body with a hard metal tip. On an outer face, adjacent to the tip, of the main body, there is arranged a wear-resistant layer composed of a hard material (hard metal or ceramic). The outer face of the tip transitions without a step into the surface of the wear-resistant layer. For this purpose, the main body has an encircling depression into which the hard material is applied. The hard material may, for example, be injectionmolded onto the chisel. The main body is of frustoconical form at its front end. The tip has a corresponding frustoconical axial recess in which the frustoconical end of the main body is received and, in this way, the tip is positioned and laterally guided. In practical use, the axial recess leads to disadvantages, because the wall thickness of the tip is reduced in the region of the axial recess. At the termination of the axial recess, a relatively sharp edge is formed between the conical face and the bottom face of the recess. High stress peaks form in the region, in particular, under mechanical load acting laterally on the tip. The stress peaks increasingly lead, in the case of the relatively small wall thickness of the tip in the region, to fracture of the tip, which is produced from a brittle hard material, and thus to failure of the chisel. A further disadvantage arises from the possible production method for such an arrangement. To prevent damage to or destruction of the tip, in particular, during a required thermal treatment during the application of the wear-resistant layer, the tip is fastened, preferably brazed, to the main body only after the wear-resistant layer has been applied to the main body. The tip is then seated on a face, which is arranged in encircling fashion around the frustoconical end, of the main body. For manufacturing reasons, the front face of the wear-resistant layer does not terminate uniformly with the encircling face on which the tip lies, but is rather arranged so as to be recessed or so as to protrude in relation to the face within the range of manufacturing tolerances. Thus, no uniform brazing gap forms between the bearing face tip, the encircling face of the main body and the front face of the wear-resistant layer, as is also illustrated in the exemplary embodiment shown in DE 90 16 655 U1. The non-uniform brazing gap leads to an inadequate brazed connection, which can detach during use and lead to loss of the tip.

SUMMARY OF THE INVENTION

It is, therefore, an object of the present invention to provide a chisel of the type mentioned in the introduction which exhibits an improved mechanical load capacity. It is a further object of the present invention to provide a method for coating a chisel head and a further method for producing a chisel head of this type.

The object of the present invention relating to the chisel is achieved in that the base part has an axially oriented recess for receiving a fastening section of the cutting element, in that the base part has, encircling the recess, a counterpart face which faces toward the cutting element, and in that the counterpart face and the front face of the wear-resistant layer form a continuous planar face, or in that the front face of the wear-resistant layer extends to the counterpart face. Since the fastening section of the cutting element is held in the recess of the base part, thin-walled sections of the cutting element, which are subjected to intense action of external forces, are avoided. The risk of breakage of the tip is, thus, considerably reduced. The planar face formed by the counterpart face and the front face makes it possible for a uniform brazing gap to be formed between the planar face and the cutting element. It is thus possible to realize an optimized brazed connection between the cutting element and the base part of the chisel, which connection is not severed even under intense mechanical load. By virtue of the fact that the base part has a recess rather than a projection for the connection to the cutting element, the continuous planar face between the counterpart face and the front face of the wear-resistant layer can be produced easily in terms of manufacturing.

The wear-resistant layer preferably extends with its front side to the counterpart side, such that the transition region is protected against washout in an effective manner. For example, the wear-resistant layer may extend to the counterpart face so as to leave a gap of less than 1 mm.

For the connection to a chisel holder, the chisel head is preferably integrally connected to a chisel shank. The chisel shank may in this case be in the form of a round shank.

The wear-resistant layer is preferably received in a depression of the base part. Here, the depression is provided in encircling fashion around the counterpart face on the outer face of the base part. It may advantageously be provided that the wear-resistant layer that is introduced terminates radially on one side with the cutting element and on the opposite side with the outer face of the base part adjacent to the depression.

The wear-resistant layer may be formed by a coating which is layered onto the base part. The wear-resistant layer may also be formed by a separate hard material element which is, for example, cohesively connected to the base part. It is conceivable here to use a brazed-on hard metal ring or individual hard-metal segments which are correspondingly adapted to the base part and which are arranged in a regular or irregular arrangement.

In accordance with a particularly preferred design variant of the present invention, it may be provided that the counterpart face and the front face are in the form of parting faces created in one working step, in particular, are in the form of cut faces or in the form of ground faces or in the form of milled faces, or that the front face is in the form of an impression face, formed during an application process, in particular during a welding process, of the wear-resistant layer, of a base of an auxiliary tool, which base lies on the counterpart face and protrudes radially beyond the counterpart face. In both cases, a continuous planar face is formed between the counterpart face and the front face. In this way, a uniform brazing gap and thus an optimized, durable brazed connection between the face formed by counterpart face and front face and the cutting element is realized.

The flow behavior of the braze can be improved by virtue of the counterpart face and/or the front face being formed as smooth faces or as faces with a predefined roughness in a range from Rz=4 μm to Rz=280 μm or as faces with channels formed therein, which channels have a channel depth in a range from 2 μm to 500 μm. The roughness or the channels may in this case be produced, for example, during the parting process during the creation of the parting faces or as an impression of the base in accordance with desired specifications.

The cutting element is subjected to high mechanical loads during use. To realize a secure connection between the cutting element and the base part, it may be provided that the cutting element forms, in encircling fashion around its fastening section, a bearing face, that the bearing face at least regionally covers the counterpart face and the front face, and that a first brazed joint is formed between the bearing face and the continuous face formed by the counterpart face and the front face, and/or that a second brazed joint is formed between an outer face of the fastening section and an inner face of the recess and/or that a third brazed joint is formed between an end face of the fastening section and a bottom face of the recess. Here, the brazed joints preferably merge into one another, such that a continuous brazed connection is provided over the entire interface between the cutting element and the base part and between the cutting element and the front face of the wear-resistant layer.

The abrasive load acting on the base part is at its greatest adjacent to the cutting element and decreases toward that end of the chisel head which faces toward the chisel shank. At the same time, the cutting element is held with its fastening section in the recess on the front end of the base part. To protect the region of the holder of the cutting element and thus prevent the cutting element from being lost, it may be provided that the wear-resistant layer, in an axial orientation, surrounds at least that section of the chisel head in which the recess is formed.

In accordance with two alternative variants of the present invention, it may be provided that the wear-resistant layer has a uniform layer thickness, or that the wear-resistant layer has a varying layer thickness. A wear-resistant layer with a uniform layer thickness is easy and inexpensive to produce. By means of a varying layer thickness, the wear-resistant layer can be adapted to the actual loads in the different regions of the chisel head.

To adapt the layer thickness to the local loads, it may be provided that the layer thickness of the wear-resistant layer decreases, proceeding from its front face facing toward the cutting element, in the direction of its end facing toward the chisel shank, or that the layer thickness of the wear-resistant layer increases, proceeding from its front face facing toward the cutting element, in the direction of its end facing toward the chisel shank. By means of a layer thickness which increases in the direction of the chisel shank, it is possible, with a diameter of the base part which remains constant in the region of the coating, to realize a conical outer contour of the chisel head, by means of which excavated material is led away from a chisel holder in which the chisel is arranged. In the case of a layer thickness which decreases in the direction of the chisel shank, the greatest layer thickness is arranged in the region of the maximum abrasive load directly downstream of the cutting element. In this way, the layer thickness is adapted to the respectively prevailing abrasion, such that similar service lives are obtained from the different regions of the wear-resistant layer.

A further possibility for adapting the layer thickness of the wear-resistant layer to the local loads consists in that an outer surface of the wear-resistant layer is convexly curved along its longitudinal extent, or in that the outer surface is concavely curved along its longitudinal extent, or in that the outer surface has alternating concavely curved and convexly curved sections along its longitudinal extent. It is additionally possible by means of the shaping of the outer surface to influence the material flow of the excavated material. A convex surface of the wear-resistant layer thus guides the excavated material further outward directly downstream of the cutting element. With suitable adaptation of the outer contour of the cutting element and of the convex shape of the outer surface of the wear-resistant layer, it can be achieved that the excavated material is diverted by the cutting element and by the wear-resistant layer in approximately the same direction, and thus a uniform material flow is realized, in the case of which regions of the chisel head further remote from the cutting element are relieved of load. By means of convex shaping of the outer surface, the front coated region facing toward the cutting element poses less resistance to the excavated material, whereas the excavated material is diverted outward with greater intensity by the rear region. Uniform loading of the wear-resistant layer along the flow direction of the excavated material can be realized in this way. By means of alternating concave and convex regions, excavated material can collect in the concave regions. This leads to additional protection against wear, because the moving excavated material in these regions does not slide past directly on the wear-resistant layer.

It may furthermore be provided that an internal angle is formed between the surface of the cutting element and the outer surface of the wear-resistant layer at the transition thereof. A brazed joint which ends at said transition region is thus set back from the main flow of the excavated material sliding past, and is thus arranged in a protected manner. This protective action is enhanced in that excavated material can collect in the internal angle and can additionally shield the brazed joint from the abrasive action of the excavated material sliding past.

A further embodiment of the present invention may comprise a segmented coating or individual segments formed from one or more hard metals, wherein the arrangement is realized by means of fastening methods known from the prior art, such as for example brazing, adhesive bonding, build-up welding or the like.

The object of the present invention relating to the chisel is furthermore achieved in that the wear-resistant layer covers at least one surface section, adjacent to the bearing face, of the cutting element. The wear-resistant layer thus covers the mutually adjacent outer surfaces both of the base part and of the cutting element. In this way, both the cutting element and the base part are protected against abrasive wear in the particularly highly loaded transition region from the cutting element to the base part. In particular, the brazed joint formed between the bearing face of the cutting element and the base part is also arranged in protected fashion, such that no hard materials can ingress into the brazed joint from the outside and thereby separate the cutting element from the base part.

The strength of the connection between the cutting element and the base part can be further improved in that a brazed joint (fourth brazed joint) is formed between the wear-resistant layer and the surface section of the cutting element. The cutting element is thus, along its bearing face and along its surface section adjacent to the bearing face, connected by brazing to the base part.

It may advantageously be provided that the wear-resistant layer protrudes beyond the counterpart face in the direction of a central longitudinal axis of the chisel head, and/or that the wear-resistant layer and the counterpart face form a cup-shaped receptacle for the cutting element. It is preferable, for this purpose, for the wear-resistant layer to be applied to the base part and for the cutting element to subsequently be brazed on. By means of the protruding wear-resistant layer or the cup-shaped receptacle, the cutting element can be positioned easily and in an exactly aligned manner on the base part and brazed to the latter. Here, the cutting element remains held in its position during the brazing process by the wear-resistant layer, which surrounds the cutting element in its region facing toward the base part.

The object of the present invention relating to the method for coating a chisel head is achieved in that an auxiliary tool is fixed to the base part of the chisel head so as to lie with at least one section of an abutment face on the counterpart face, in that, in a first method step, the outer face is coated with the wear-resistant layer, and in that, subsequently, the auxiliary tool is removed. The wear-resistant layer is thus applied to the outer face of the base part of the chisel head, whereby said base part is protected against mechanical damage and abrasion during later use. The auxiliary tool prevents the counterpart face, onto which the cutting element is brazed in the second manufacturing process, from being jointly coated during the coating process. A defined face for the brazing-on of the cutting element is thus maintained. Furthermore, with the auxiliary tool, the external shape of the wear-resistant layer in its transition region to the cutting tool is predefined, such that a predetermined brazing face with respect to the cutting tool is produced here too.

In accordance with a preferred method variant, it may be provided that the wear-resistant layer is applied to the outer face of the chisel so as to bear with its front face against at least one section of the abutment face of the auxiliary tool and/or so as to bear against a surface region of the auxiliary tool, which surface region is adjacent to the abutment face and has a spatial orientation which deviates from the abutment face. Depending on the design of the auxiliary tool, it is, thus, possible to produce a different contour of that surface of the wear-resistant layer which is later adjacent to the cutting element. It is thus possible for the contour of that surface of the wear-resistant layer which faces toward the cutting element to be adapted to the contour of the cutting element. The contour of the auxiliary tool and thus the contour of the surface of the wear-resistant layer are predefined so as to follow the contour of the cutting element when the cutting element has been brazed on. It is thereby achieved that a uniform brazing gap is formed along the interface between the cutting element and the wear-resistant layer. If the auxiliary tool protrudes, for example, with its abutment face radially beyond the counterpart face of the base part, it is thus possible for the wear-resistant layer to extend to the abutment face. A front face of the wear-resistant layer is thus formed which is arranged radially with respect to the counterpart face of the base part and which forms a planar face with said counterpart face. In a subsequent manufacturing step, the cutting element can be placed with its bearing face onto the counterpart face and the front face and connected thereto by brazing. Alternatively or in addition to this, it may be provided that the wear-resistant layer is applied to a surface adjacent to the abutment face of the auxiliary tool. The adjacent surface is oriented so as to follow the contour of that surface of the cutting element which is adjacent to the bearing face. If, in a subsequent manufacturing step, the cutting element is placed with its bearing face onto the counterpart face of the base part, that surface of the cutting element which is adjacent to the bearing face is situated opposite the wear-resistant layer so as to be spaced apart by a brazing gap of defined width. The wear-resistant layer thus surrounds a part of the outer surface of the cutting element. The cutting element may be connected to the base part by brazing, wherein the brazing gap is formed along the interface between the cutting element on one side and the counterpart face and the wear-resistant layer on the other side.

The object of the present invention relating to the method for producing a chisel head is achieved in that the base part of the chisel head is produced in a size which, in relation to its final dimension, is lengthened in the direction of the cutting element, in that the wear-resistant layer is applied to the outer face of the lengthened base part, and in that the base part together with the wear-resistant layer is subsequently truncated along a parting line (T). The parting face thus formed constitutes a continuous, planar face between a formed counterpart face as front termination of the base part and the formed front face of the wear-resistant layer. The planar face promotes the formation of a uniform brazing gap with respect to the cutting element which covers the counterpart face and the front face, which cutting element is brazed onto the base part in a subsequent method step.

The wear-resistant layer may preferably be applied to the outer face of the chisel head by means of a welding process.

The welding process permits the production of an inexpensive and durable wear-resistant layer. The disadvantage of the welding method, that an open face-side terminating face of the obtained coating can be defined only inaccurately in terms of its position and it is, therefore, not possible to produce a continuous, planar face with respect to an adjacent counterpart face, is eliminated by means of the described parting method.

A robust wear-resistant layer and thus a durable chisel can be obtained if a layer composed of a hard material, in particular of hard metal, and/or of an iron alloy and/or of a nickel alloy and/or of a cobalt alloy and/or of a titanium alloy and/or of tungsten carbide and/or of titanium carbide, is applied as a wear-resistant layer.

BRIEF DESCRIPTION OF THE DRAWINGS

The present invention will be discussed in more detail below on the basis of an exemplary embodiment illustrated in the drawings, in which.

DETAILED DESCRIPTION OF THE INVENTION

Figure 1:
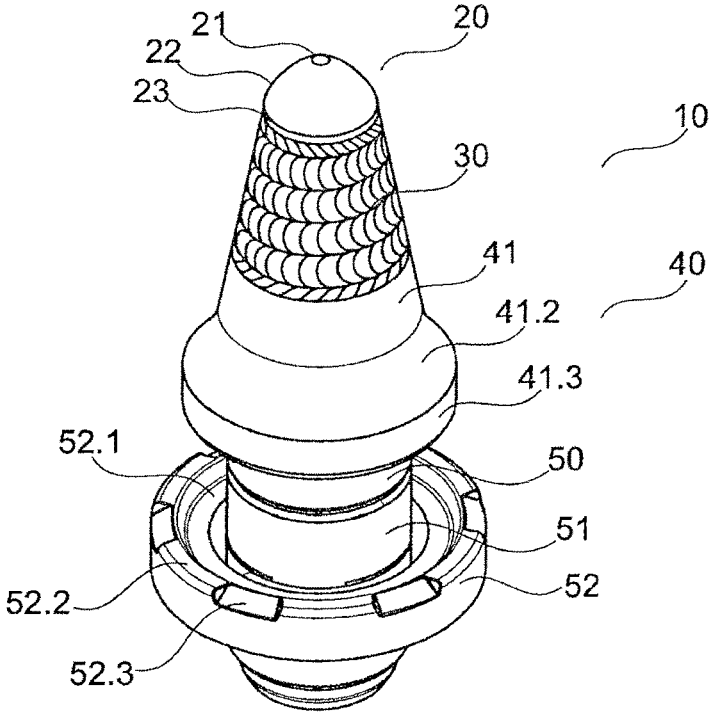
FIG. 1 shows, in a perspective side view, a chisel having a chisel shank and having a chisel head with a wear-resistant layer.

FIG. 1 shows, in a perspective side view, a chisel 10 having a chisel shank 50 and having a chisel head 40 with a wear-resistant layer 30. The chisel 10 is in the form of a round-shank chisel. The chisel head 40 is assigned a cutting element 20 composed of a hard material, for example, of hard metal. The cutting element 20 is connected, in the present exemplary embodiment by brazing, to a base part 41, which tapers conically toward the cutting element 20, of the chisel head 40. In a region facing toward the cutting element 20, the base part 41 is coated with the wear-resistant layer 30 in an encircling manner around the cutting element 20. The wear-resistant layer 30 is composed of a hard material and is applied to the base part 41 by means of a welding process. In the exemplary embodiment shown, the wear-resistant layer 30 is formed from hard metal. It may also be produced from an iron alloy, from a nickel alloy, from a cobalt alloy, from a titanium alloy, from tungsten carbide or from titanium carbide.

Figure 2:
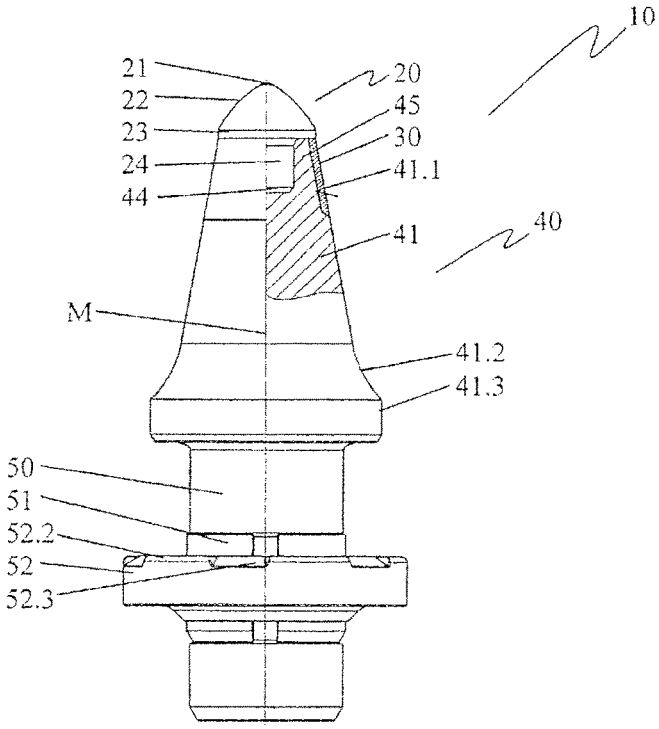
FIG. 2 shows the chisel shown in FIG. 1 in a lateral, partially sectional illustration.

Proceeding from the base part 41, the chisel head 40 widens via a transition region 41.2 to a collar 41.3 with constant outer diameter. The collar 41.3 transitions into the chisel shank 50. A fastening sleeve 51 is arranged around the chisel shank 50. The fastening sleeve 51 is formed as a clamping sleeve which is formed from a resiliently elastic material, for example, steel sheet. As illustrated in FIG. 2, fastening sleeve 51 has a longitudinal slot which is delimited by sleeve edges. Owing to the longitudinal slot, the fastening sleeve diameter can be varied, wherein the sleeve edges move toward one another (small diameter) or are spaced further apart from one another (large sleeve diameter). In this way, different clamping states can be realized. A supporting element 52 in the form of a wear prevention disk is pulled onto the fastening sleeve 51. The supporting element 52 has a circular cross section and is extended through by a bore. Here, the bore is dimensioned such that the fastening sleeve 51 is, in relation to its relaxed state, held in a preloaded state with reduced outer diameter. The outer diameter thus generated is selected such that the fastening sleeve 51 can be pushed with little or no expenditure of force into a chisel receptacle of a chisel holder (not illustrated). The pushing-in movement is delimited by means of the supporting element 52. During the further insertion of the chisel shank 50 into the bore, the supporting element 52 is moved into a region of the chisel shank 50 which is not surrounded by the fastening sleeve 51. Then, the fastening sleeve 51 springs open radially and becomes clamped in the bore of the chisel holder. In this way, the chisel 10 is held captively in an axial direction but so as to be freely rotatable in a circumferential direction. As is also shown in FIG. 1, the supporting element 52, oriented toward the chisel head 40, forms a supporting face 52.1, which is surrounded by an edge 52.2, for the support of the collar 41.3 of the chisel head 40. The edge 52.2 is interrupted by edge recesses 52.3.

Proceeding from a front cutting tip 21, the cutting element 20 has a convexly shaped cutting edge face 22 which transitions into a pedestal 23 which terminates radially with the wear-resistant layer 30.

For use, the chisel 10 is installed, so as to be mounted rotatably about its central longitudinal axis M shown in FIG. 2, on a chisel holder on a rotating drum carrier. As a result of the rotation of the drum carrier, the cutting element 20 penetrates into the material to be removed, for example, asphalt or earth, and comminutes the material. The excavated material slides past the chisel head 40 and is guided outward by the base part 41 with the encircling wear-resistant layer 30 and the transition region 41.2. A chisel carrier in which the chisel 10 is held is thus protected in the best possible manner against abrasion by the excavated material.

The mechanical load on the chisel head 40 is at its greatest in the region of the cutting element 20. Therefore, the cutting element 20 is manufactured from a hard material, resulting in a long service life of the chisel 10. In order, in particular, to increase the service life of the base part 41 in its mechanically highly loaded region adjacent to the cutting element 20, the wear-resistant layer 30 is applied there.

FIG. 2 shows the chisel 10 shown in FIG. 1 in a lateral, partially sectional illustration. The section exposes a part of the base part 41 of the chisel head 40. As can be seen there, a recess 44 is provided in the base part 41 at that end of the base part 41 which faces toward the cutting element 20. The recess 44 has a cylindrical contour and is oriented axially along the central longitudinal axis M of the chisel 10. The cutting element 20 forms, in relation to the cutting tip 21, a likewise cylindrical fastening section 24, which is held in the recess 44 of the base part. The cutting element 20 is brazed to the base part 41 and is thus connected securely and durably to the base part 41.

The wear-resistant layer 30 surrounds the region of the recess 44. A relatively thin-walled web 45 of the base part 41 which encloses the recess 44 is thereby protected against abrasive wear. In this way, the web 45 is prevented from being prematurely worn away by excavated material sliding past, which would lead to the loss of the cutting element 20 and thus to premature failure of the chisel 10 as a whole.

Figure 3:
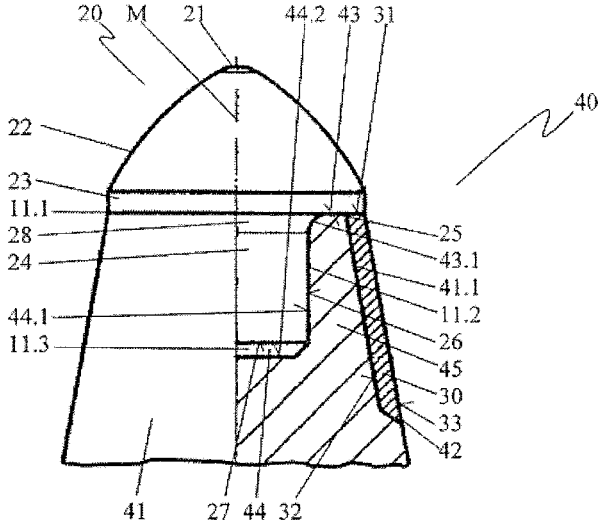
FIG. 3 shows a detail of the chisel shown in FIG. 2.

FIG. 3 shows a detail of the chisel 10 shown in FIG. 2 in the region of the cutting element 20. As can be seen in the enlarged illustration, a depression 42 is provided in an encircling manner around the base part 41 in a region facing toward the cutting element 20, into which depression the wear-resistant layer 30 is introduced. An outer surface 33 of the wear-resistant layer 30 thus terminates with the pedestal 23 and with that surface of the base part 41 which runs adjacent to the depression 42. An inner surface 32 of the wear-resistant layer 30 forms a firm connection to an outer face 41.1 of the base part 41 onto which the wear-resistant layer 30 is applied. A front face 31, facing toward the cutting element 20, of the wear-resistant layer 30 is covered by a radially oriented bearing face 25 of the cutting element 20, which bearing face 25 forms the termination of the pedestal 23 in the direction of the base part 41. The web 45 of the base part 41 is terminated in the direction of the cutting element 20 by a counterpart face 43. The counterpart face 43 and the front face 31 of the wear-resistant layer 30 form a continuous planar face. In the exemplary embodiment shown, the face is arranged radially and is covered by the bearing face 25 of the cutting element 20.

The bearing face 25 of the cutting element 20 transitions via a connection region 28 of rounded form into the fastening section 24. The rounding of the connection region 28 is situated opposite a rounding face 43.1 of the base part 41, via which the counterpart face 43 transitions into an inner face 44.1 of the recess 44. An outer face 26 of the fastening section 24 is arranged opposite the inner face 44.1 of the recess 44. An end face 27 which terminates the fastening section 24 is situated so as to be spaced apart from a bottom face 44.2 of the recess 44 of the base part 41.

A first brazed joint 11.1 is formed between the front face 31 of the wear-resistant layer 30 and the counterpart face 43 of the base part 41, on one side, and the bearing face 25 of the cutting element 20, on the opposite side. A second brazed joint 11.2 arranged between the inner face 44.1 of the recess 44 and the outer face 26 of the fastening section 24 of the cutting element 20 adjoins the first brazed joint 11.1 in a continuous fashion. A third brazed joint 11.3 is formed, so as to adjoin the second brazed joint 11.2, between the bottom face 44.2 of the recess 44 and the end face 27 of the fastening section 24.

The face formed by the front face 31 and the counterpart face 43 is continuous and planar. In this way, a first brazed joint 11.1 with a uniform thickness is realized between the face and the opposite bearing face 25. A uniform thickness of the brazed joints 11.1, 11.2, 11.3 is a prerequisite for a stable and durable brazed connection. The planar face formed from the front face 31 and the counterpart face 43 may be produced by means of a parting or chip-removing manufacturing step or by means of a molding process during the application of the wear-resistant layer 30, as discussed in more detail with regard to FIGS. 5 and 6. It is advantageous here that the counterpart face 43 and the front face 31 form the front termination of the base part 41, such that, for example, it is possible for chip-removing manufacturing processes to be performed over the full area of the front termination of the base part 41 after the application of the wear-resistant layer 30 and before the brazing-on of the cutting element.

By means of the brazed joints 11.1, 11.2, 11.3 that are formed, the cutting element 20 is held securely in the base part 41 of the chisel head 40. By means of the design of the cutting element 20 with a fastening section 24 held in the recess 44 of the base part 41, it is possible for thin-walled regions of the relatively brittle cutting element 20 to be avoided. Furthermore, by means of the rounded transition from the bearing face 25 to the outer face 26 of the fastening section 24, stress peaks are avoided. Both measures considerably reduce the risk of breakage of the cutting tip 21.

The wear-resistant layer 30 is introduced into the depression 42. In this way, protruding edges at the transition of the wear-resistant layer 30 to the pedestal 23 and to the outer face 41.1 of the base part 41 outside the depression 42 are avoided, whereby both the abrasive wear of the chisel head 40 and the energy consumption during the use of the chisel 10 are reduced. The front face 31 of the wear-resistant layer 30 is covered by the cutting element 20 and by the braze-filled first brazed joint 11.1. In this way, excavated material is prevented from passing between the outer face 41.1 of the base part 41 and the inner surface 32 of the wear-resistant layer 30 and breaking these apart.

An internal angle is formed between the pedestal 23 and the outer surface 33 of the wear-resistant layer 30, at the apex of which internal angle the first brazed joint 11.1 ends. The first brazed joint 11.1 with the relatively soft braze material is thus arranged so as to be set back in relation to the main flow of excavated material sliding past, and is thereby additionally protected against wear.

FIGS. 4*a* to 4*i* show, in lateral, sectional illustrations, a detail of the chisel head 40 with different embodiments of the wear-resistant layer 30.

Figure 4A:
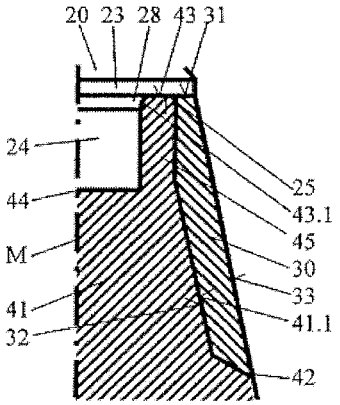
FIGS. 4*a*-4*i* show, in lateral sectional illustrations, a detail of the chisel head with different embodiments of the wear-resistant layer.

In the embodiment as per FIG. 4*a*, the outer face 41.1 of the base part 41 runs initially cylindrically in the region of the web 45 and then transitions into a conically widening region. The outer surface 33 of the wear-resistant layer 30 runs continuously conically. By means of this design, it is achieved that the web 45 has a uniform thickness with a continuously relatively large material thickness. In this way, high transverse forces acting via the cutting element 20 can be reliably accommodated. The wide counterpart face 43 that is formed yields secure seating of the cutting element 20 on the base part 41 and a large-area brazed connection between the bearing face 25 of the cutting element 20 and the counterpart face 43.

Figure 4B:
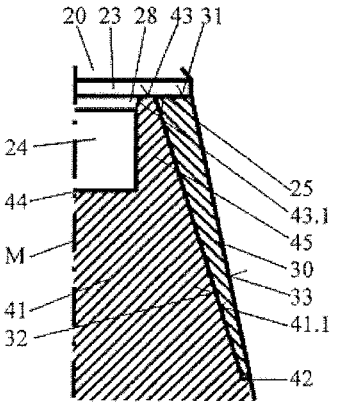

In FIG. 4*b*, the wear-resistant layer 30 has its greatest layer thickness in its region facing toward the cutting element 20, which layer thickness decreases continuously toward the opposite end of wear-resistant layer 30. The mechanical load on and thus the abrasive wear of the wear-resistant layer 30 is at its greatest directly adjacent to the cutting element 20 and decreases in the direction of the collar 41.3 of the chisel head 40. By means of the illustrated distribution of the layer thickness, a uniform service life of the wear-resistant layer 30 over its entire extent is achieved. By means of the adaptation of the layer thickness in the direction of the collar 41.3, the material consumption during the production of the wear-resistant layer 30 is optimized taking into consideration the expected mechanical load on the wear-resistant layer 30 in the different regions along the chisel head 40.

Figure 4C:
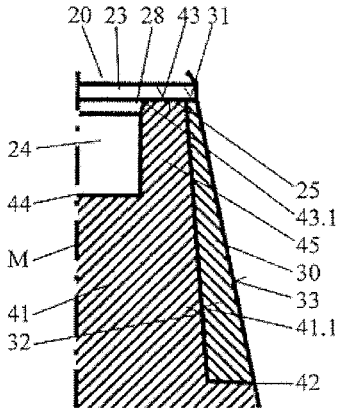

Correspondingly to FIG. 4*c*, the wear-resistant layer 30 has its smallest layer thickness in its region facing toward the cutting element 20, which layer thickness increases continuously toward the opposite end of wear-resistant layer 30. In this way, too, a web 45 with a uniform, relatively large material thickness is realized, with the advantages already mentioned with regard to FIG. 4*a*. The outer face 41.1 of the base part 41 may, in the region of the depression 42, be of cylindrical form with a uniform spacing to the central longitudinal axis M of the chisel 10 and thus be of easily producible design, while the conical outer contour of the chisel head 40 is maintained.

Figure 4D:
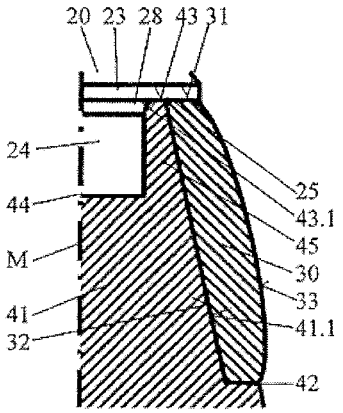

FIG. 4*d* shows a design variant in which the outer surface 33 of the wear-resistant layer 30 is of convex shape. By means of this shaping, a transition without protruding edges, which lead to increased abrasion, is achieved in each case between the cutting element 20 and the wear-resistant layer 30 and between the wear-resistant layer 30 and the outer face 41.1, adjacent to the depression 42, of the base part 41. At the same time, the wear-resistant layer 30 is provided with a large material thickness, whereby long service lives of the chisel head 40 and thus of the chisel 10 can be achieved. The outer surface 33 of the wear-resistant layer 30, which is subject to wear, is oriented in approximately the same direction as the surface profile of the cutting edge face 22 of the cutting element 20, resulting in a uniform material flow of the excavated material. The internal angle between the pedestal 23 and the cutting edge face 22 tapers to a relatively sharp point, such that the first brazed joint 11.1 is arranged so as to be considerably setback in relation to the main material flow of the excavated material and is thus protected. Likewise, an internal angle is formed at the transition of the outer surface 33 to the outer face 41.1 laterally with respect to the depression 42, such that the connecting region between the material of the wear-resistant layer 30 and the material of the base part 41 is also setback in relation to the material flow of the excavated material and is thereby arranged in protected fashion.

Figure 4E:
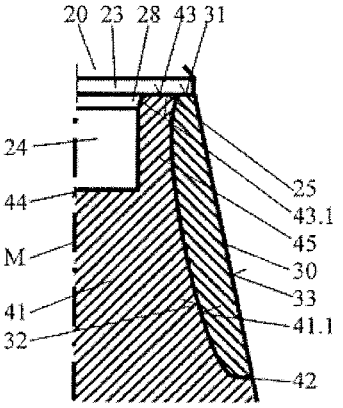

FIG. 4*e* shows an embodiment in which the outer surface 33 of the wear-resistant layer is designed to run conically. The outer face 41.1 of the base part 41 is of concave design in the region of the depression 42, such that the inner surface 32 of the wear-resistant layer 30 is of convex form. In this way, a large layer thickness of the wear-resistant layer 30, with a correspondingly long service life, is realized. The web 45 with the counterpart face 43 that is formed, is of correspondingly thick-walled or large-area design, with the associated advantages already described with regard to FIG. 1. The conical outer surface 33 yields edge-free transitions at the edges of the wear-resistant layer 30 and thus the reduced abrasion and energy consumption as already described.

Figure 4F:
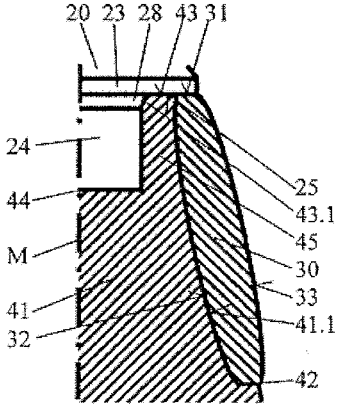

In FIG. 4*f*, both the inner surface 32 and the outer surface 33 of the wear-resistant layer 30 are of convex form. In this way, the advantages of the design variant of a convex outer surface 33 as shown in FIG. 4*d* can be combined with the advantages of a convex inner surface 32 as discussed with regard to FIG. 4*e*.

Figure 4G:
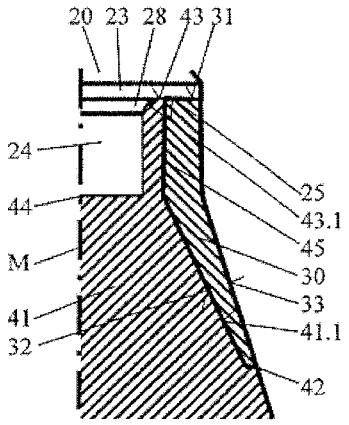

In the design variant as per FIG. 4*g*, the outer face 41.1 of the base part 41 is of cylindrical design in the region of the web 45 and is of conical design adjacent to the web 45. The outer surface 33 of the wear-resistant layer 30 follows this shaping, wherein the conical region of the outer surface 33 runs more steeply than the conical region of the outer face 41.1. The layer thickness of the wear-resistant layer 30 is selected to be at its greatest in the region of the web 45 and thus of the highest mechanical load on the base part 41, and decreases within the conical regions. Owing to the outer surface 33, which is of cylindrical design in the region of the web 45, of the wear-resistant layer 30, the wear-resistant layer 30 is setback in relation to the main flow direction of the excavated material predefined by the shaping of the cutting element 20, such that the abrasion in the region is reduced in relation to a conical or concave design of the outer surface 33. In this way, and as a result of the large layer thickness of the wear-resistant layer 30, the relatively thin-walled web 45 is protected in the best possible manner against wear.

Figure 4H:
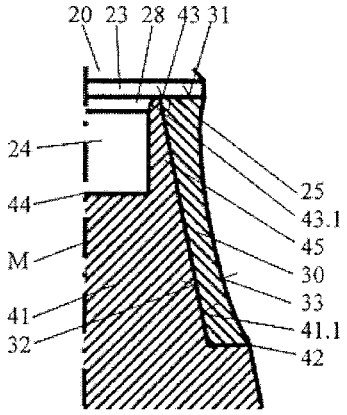

A similar effect is realized by the embodiment of the wear-resistant layer 30 shown in FIG. 4*h* with a concave outer surface 33 and a conically running inner surface 32. In this case, too, a large layer thickness is realized in the region of the web 45 and thus in the highly loaded direct vicinity of the cutting element 20. The outer surface 33 runs, in the region of the web 45, in the context of the deviation by means of the conical shaping, approximately in the direction of the surface of the pedestal 23. As a result, the region of the web 45 provides only a small surface for the excavated material sliding past to act on, whereby the abrasion in the region of the relatively thin-walled web 45 is kept low. In the further concave profile of the outer surface 33, the excavated material is guided outward away from the chisel 10, and thus the non-coated region of the chisel head 40 is protected. As a result of the conical shaping of the coated outer face 41.1 of the base part 41, the material thickness of the web 45 increases toward the base thereof, such that even high transverse forces introduced by the cutting element 20 can be accommodated without damage to the web 45.

Figure 4I:
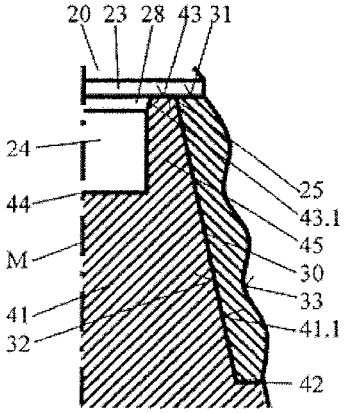

FIG. 4*i* shows a detail of the chisel head 40 with a wear-resistant layer 30, the outer surface 33 of which has alternating concave and convex regions. Excavated material can accumulate in the concave regions, such that the excavated material sliding past at the outside is, at least in the concave regions, not in direct contact with the outer surface 33 of the wear-resistant layer 30. By means of this simple measure, the abrasion of the wear-resistant layer 30 can be considerably reduced.

Figure 5:
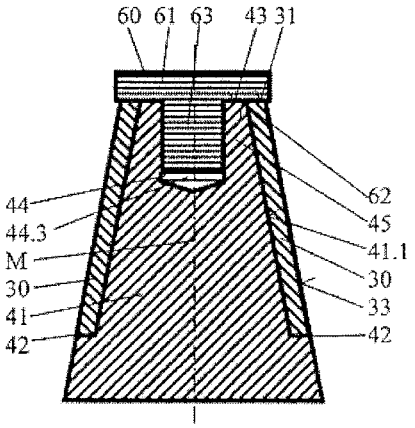
FIG. 5 shows, in a further lateral sectional illustration, a detail of the chisel head with an auxiliary tool.

FIG. 5 shows, in a further lateral sectional illustration, a detail of the chisel head 40 with an auxiliary tool 60. The chisel head 40 is, in this case, present still in the form of a semifinished part without the brazed-on cutting element 20. FIG. 5 shows one possibility for coating the base part 41 of the chisel head 40 with the wear-resistant layer 30, such that a continuous planar face forms between the front face 31 of the wear-resistant layer 30 and the counterpart face 43 of the base part 41.

FIG. 5 shows a chisel head 40 with a wear-resistant layer 30 which has a uniform layer thickness. The method may, however, also be applied to any other embodiment of the wear-resistant layer 30 as shown by way of example in FIGS. 4*a* to 4*i*.

The auxiliary tool 60 is formed from a base 61, in the center of which there is arranged an axially oriented positioning peg 63. The diameter of the base 61 is selected so as to protrude radially beyond the wear-resistant layer 30. The positioning peg 63 is designed such that it can be inserted with little lateral play into the recess 44 of the chisel head 40. The positioning peg 63 ends so as to be spaced apart from the closure of the recess 44 by a gap 44.3. In the present exemplary embodiment of the present invention, the auxiliary tool 60 is produced from a metal, preferably from copper.

Before the application of the wear-resistant layer 30, the auxiliary tool 60 is fixed with its positioning peg 63 in the recess 44 such that the auxiliary tool 60 lies with a shape-imparting abutment face 62, which runs around the positioning peg 63, on the counterpart face 43 of the base part 41. Subsequently, the wear-resistant layer 30 is introduced into the depression 42. For this purpose, the wear-resistant layer 30 is applied by means of a welding process so as to bear against the abutment face 62 of the base 61. Thus, a front face 31 of the wear-resistant layer 30 is formed which transitions in planar and continuous fashion into the counterpart face 43 of the base part 41. After the coating process, the auxiliary tool 60 is removed.

By means of a corresponding structuring of the shape-imparting abutment face 62, the front face 31 of the wear-resistant layer 30 may be smooth or may be equipped with a predefined roughness or with some other structure, for example, with channels. Here, a roughness in a range from Rz=4 μm to 280 μm or channel depths in a range from 2 μm to 500 μm is/are advantageously provided. The surface structure of the front face 31 can thus be optimized for a good flow of the brazing agent.

Figure 6:
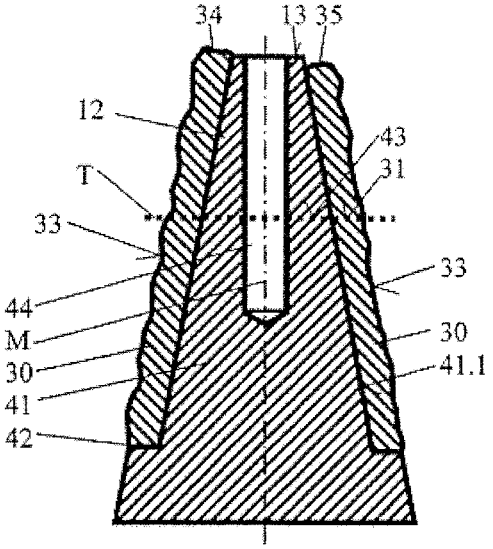
FIG. 6 shows, in a further lateral sectional illustration, a detail of a chisel head in a size lengthened in the direction of the cutting element in relation to its final dimension.

FIG. 6 shows, in a further lateral sectional illustration, a detail of a chisel head 40 in a size lengthened in the direction of the cutting element 20 in relation to its final dimension. FIG. 6 also shows a semifinished part in which the cutting element 20 has not yet been applied. The subsequent final dimension of the base part 41 is marked by a parting line T. The base part 41 has been lengthened by the extent of an excess length 12. The depression 42 of the base part 41 continues in the excess length 12. The axial recess 44 is also formed in the base part 41 and in the excess length 12. The excess length 12 ends at a radially oriented terminating face 13.

FIG. 6 shows a chisel head 40 with a wear-resistant layer 30 which has a uniform layer thickness. The method can, however, be applied to any other embodiment of the wear-resistant layer 30 as shown by way of example in FIGS. 4*a* to 4*i*.

The wear-resistant layer 30 has been introduced into the depression 42 of the elongated chisel head 40 by means of a welding process. The illustration schematically shows the rough outer surface 33, resulting from the welding process, of the wear-resistant layer 30.

Likewise for manufacturing reasons, the wear-resistant layer 30 does not end flush with and in the same plane as the front terminating face 13 of the excess length 12. In the exemplary embodiment shown, in relation to the terminating face 13, the wear-resistant layer 30 forms a protruding bead 34 on one side of the excess length 12 and forms a recessed bead on the opposite side. Both are unsuitable for the formation of a durable brazed connection with a uniform brazed joint 11.1, 11.2, 11.3 with respect to a rectilinearly running surface such as is provided by the bearing face 25 of the cutting element 20.

To form the demanded planar face between the counterpart face 43 of the base part 41 and the front face 31 of the wear-resistant layer 30, the excess length 12 is separated from the base part 41 along the parting line T. This may be realized by means of a parting process, for example, by sawing, or by means of a chip-removing manufacturing process, such as, for example, milling. The parting face may also be machined further in a subsequent machining step. It is accordingly possible for a defined roughness of the parting face to be produced, or channels or other structures may be formed into the parting face, which improve the flow behavior of a braze used for the brazing-on of the cutting element 20. The roughness may, for this purpose, be set in a range between Rz=4 μm and 280 μm, or channels may be formed in with a channel depth in a range between 2 μm and 500 μm.

After both the production methods described with regard to FIGS. 5 and 6, a continuous and planar face formed from the counterpart face 43 and the front face 31 is obtained, opposite which the bearing face 25 of the cutting element 20 can be positioned and brazed. A uniform and thus durable first brazed joint 11.1 is formed, as shown in FIGS. 1 to 4.

Figure 7:
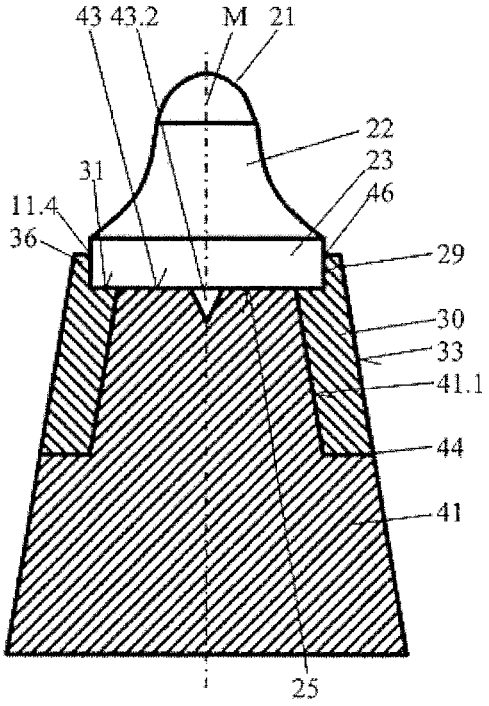
FIG. 7 shows, in a lateral sectional illustration, a detail of a wear-resistant layer which protrudes in an axial direction.

FIG. 7 shows, in a lateral sectional illustration, a detail of a wear-resistant layer 30 which protrudes in an axial direction.

The cutting element 20 is formed from the cutting tip 21, from the cutting edge face 22, which is of concave shape in the exemplary embodiment shown, and from the pedestal 23. The pedestal 23 forms a continuous and planar bearing face 25 which is oriented toward the base part 41 of the chisel head 40.

The wear-resistant layer 30 is introduced into the recess 44 which is arranged in encircling fashion around the base part 41. Here, a radially inner part of the wear-resistant layer 30 terminates, in the direction of the cutting element 20, with the counterpart face 43 of the base part 41 and forms the front face 31 there. The cutting element 20 lies with its support face 25 on the counterpart face 43 and the front face 31 via a brazed connection. Here, cutting element 20 covers a centering notch 43.2 which is formed into the counterpart face 43 along the central longitudinal axis M of the chisel head 40.

Laterally with respect to the front face 31, the wear-resistant layer 30 protrudes in an axial direction beyond the counterpart face 43 and the front face 31. The wear-resistant layer 30 thus forms a centering collar 36 which surrounds the pedestal 23 of the cutting element 20 in its region facing toward the base part 41. The wear-resistant layer 30 thus covers a surface section 29, adjacent to the bearing face 25, of the cutting element 20. A fourth brazed joint 11.4 is formed between the surface section 29 and the centering collar 36.

The wear-resistant layer 30 forms, together with the counterpart face 43 of the base part 41, a cup-shaped receptacle 46 into which the cutting element 20 is brazed by way of its pedestal 23. By means of the cup-shaped receptacle 46, the cutting element 20 is correctly oriented and held in its position during the brazing process. A brazed connection is formed between the counterpart face 43, the front face 31 and the centering collar 36 at one side and the cutting element 20 at the other side. The cutting element 20 is thus securely connected to the base part 41 of the chisel head 40. That section of the brazed connection which is formed between the bearing face 25 and the counterpart face 43 or the front face 31 is arranged so as to be protected by the encircling centering collar 36 of the wear-resistant layer 30. This yields a permanent connection, which is protected against wear, between the cutting element 20 and the base part 41.

Figure 8:
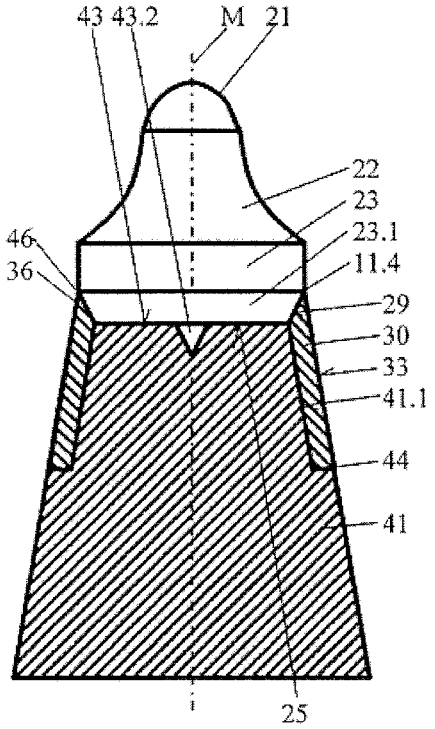
FIG. 8 shows, in a lateral sectional illustration, a detail of a chisel head in a further embodiment of a wear-resistant layer which protrudes in an axial direction.

FIG. 8 shows, in a lateral sectional illustration, a detail of a chisel head 40 in a further embodiment of a wear-resistant layer 30 which protrudes in an axial direction.

The cutting element 20 substantially corresponds to the cutting element 20 illustrated in FIG. 7, wherein a pedestal projection 23.1 is integrally formed on the pedestal 23 on the region facing toward the base part 41 of the chisel head 40. The pedestal projection 23.1 has a cross section which narrows in conical form toward the base part 41.

The centering collar 36 of the wear-resistant layer 30 follows the conically running surface section 29 of the pedestal 23, which is arranged in the region of the pedestal projection 23.1. The pedestal projection 23.1, as that section of the cutting element 20 which faces toward the base part 41, is thus covered by the wear-resistant layer 30.

In this case, too, the pedestal projection 23.1 and the counterpart face 43 of the base part form a cup-shaped receptacle 46 into which the cutting element 20 is brazed. The brazed joint region formed between the bearing face 25 and the counterpart face is thus surrounded in encircling fashion, and thereby protected, by the wear-resistant layer 30. By means of the fourth brazed joint 11.4, the area of the brazed connection formed between the base part 41 and the cutting element 20 is enlarged, such that a firm connection is formed between the cutting element 20 and the base part 41.

Figure 9:
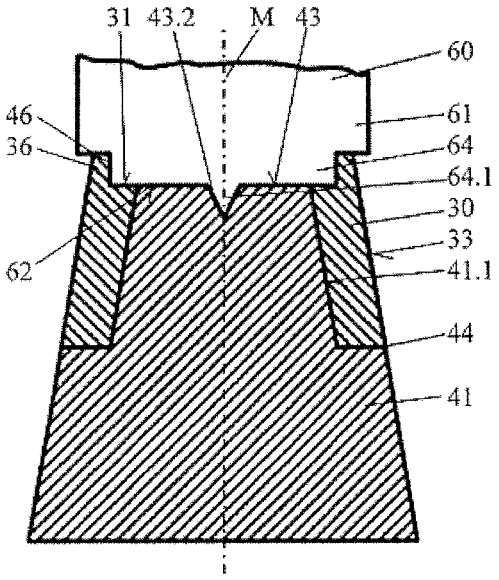
FIG. 9 shows, in a lateral sectional illustration, a detail of the chisel head with an auxiliary tool.

FIG. 9 shows, in a lateral sectional illustration, a detail of the chisel head 40 with an auxiliary tool 60.

Here, the base part 41 and the wear-resistant layer 30 of the chisel head 40 have the same shape as already described with regard to FIG. 7, with FIG. 7, however, showing the inserted cutting element 20.

The auxiliary tool 60 is formed from a base 61 on which a projection 64 is integrally formed. The auxiliary tool 60 is of rotationally symmetrical construction about the central longitudinal axis M. The projection 64 has a smaller diameter than the base 61. The projection 64 lies with its abutment face 62 against the counterpart face 43 of the base part 41 and against the front face 31 of the wear-resistant layer 30. In the center of the abutment face 62, there is integrally formed a centering spike 64.1 which engages into the centering notch 43.2 of the base part 41.

The auxiliary tool 60 is placed with its abutment face 62 onto the counterpart face 43 of the base part 41 before the wear-resistant layer 30 is applied. Here, the centering spike 64.1 engages into the centering notch 43.2, such that the auxiliary tool 60 is oriented relative to the base part 41. Subsequently, the wear-resistant layer 30 is applied, preferably by welding. The wear-resistant layer 30 is, in this case, applied so as to fill the recess 44. On the side of the auxiliary tool 60, the wear-resistant layer 30 is applied onto that face of the abutment face 62 of the auxiliary tool 60 which protrudes beyond the counterpart face 43 of the base part 41 and onto the outer surface of the projection 64 of the auxiliary tool 60. The face surface 31 and the centering collar 36 are thus formed, which centering collar 36 protrudes axially beyond the counterpart face 43 and, in the present exemplary embodiment, beyond the front face 31 of the wear-resistant layer 30. The centering collar 36 is delimited by the base 61 of the auxiliary tool 60.

After the coating process, the auxiliary tool 60 is removed. The wear-resistant layer 30 of step form remains as an impression of the auxiliary tool 60. The cutting element 20 can be brazed into the cup-shaped receptacle 46 thus formed, as shown in FIG. 7.

The contour of the auxiliary tool 60 is configured so as to follow the contour of the cutting element 20 that is provided. To produce the chisel 10 illustrated in FIG. 8, it is, for example, possible for an auxiliary tool 60 to be provided, the projection 64 of which narrows conically proceeding from the base 61. In this way, a centering collar 36 corresponding to that shown in FIG. 8 is obtained, which follows the conical shape of the pedestal projection 23.1 of the cutting element 20 shown there.

The auxiliary tool shown in FIGS. 5 and 9 is preferably manufactured from a material which does not form a metallurgical connection with the wear-resistant layer. The auxiliary tool may be manufactured, for example, from copper.

To produce the cup-shaped receptacle 46, it is also possible, in accordance with an alternative production method, for an elongated base part 41 to firstly be coated and subsequently truncated, as described with regard to FIG. 6. The cup-shaped receptacle 46 may subsequently be formed into the base part 41 and the wear-resistant layer 30 by means of a subsequent machining step, in particular, by milling or drilling.

The invention claimed is:

1. A chisel comprising a chisel head and a chisel shank, wherein the chisel head is formed at least from a base part and from a cutting element which is connected to the base part and which is composed of a hard material, wherein the base part has, adjacent to the cutting element, a wear-resistant layer on an outer face of the cutting element, which wear-resistant layer covers at least one section, facing toward the cutting element, of the outer face of the base part, and wherein a front face, facing toward the cutting element, of the wear-resistant layer is covered by the cutting element, wherein the base part has an axially oriented recess for receiving a fastening section of the cutting element, wherein the base part has, encircling the recess, a counterpart face which faces toward the cutting element, and wherein the counterpart face and the front face of the wear-resistant layer form a continuous planar face, or wherein the front face of the wear-resistant layer extends to the counterpart face, and wherein the cutting element forms, in encircling fashion around a fastening section of the cutting element, a bearing face, wherein the bearing face at least regionally covers the counterpart face and the front face, and wherein a first brazed joint is formed between the bearing face and the continuous face formed by the counterpart face and the front face.

2. The chisel according to claim 1, wherein the wear-resistant layer is received in a depression of the base part.

3. The chisel according to claim 1, wherein the counterpart face and the front face are in the form of faces created in one working step, or wherein the front face is in the form of a face, formed during an application process of the wear-resistant layer, of a base of an auxiliary tool, which base lies on the counterpart face and protrudes radially beyond the counterpart face.

4. The chisel as claimed in claim 3, wherein the counterpart face and the front face created in one working step are in the form of cut faces or in the form of ground faces or in the form of milled faces.

5. The chisel as claimed in claim 3, wherein the application process is a welding process.

6. The chisel according to claim 1, wherein at least one of the counterpart face and the front face are formed as smooth faces or as faces with a predefined roughness in a range from Rz=4 μm to Rz=280 μm or as faces with channels formed therein, which channels have a channel depth in a range from 2 μm to 500 μm.

7. The chisel according to claim 1, wherein a second brazed joint is formed between an outer face of the fastening section and an inner face of the recess.

8. The chisel according to claim 7, wherein a third brazed joint is formed between an end face of the fastening section and a bottom face of the recess.

9. The chisel according to claim 1, wherein the wear-resistant layer, in an axial orientation, surrounds at least a section of the chisel head in which the recess is formed.

10. The chisel according to claim 1, wherein the wear-resistant layer has a uniform layer thickness.

11. The chisel according to claim 1, wherein a layer thickness of the wear-resistant layer decreases, proceeding from a front face of the wear-resistant layer facing toward the cutting element, in the direction of an end of the wear-resistant layer facing toward the chisel shank, or wherein the layer thickness of the wear-resistant layer increases, proceeding from a front face of the wear-resistant layer facing toward the cutting element, in the direction of an end of the wear-resistant layer facing toward the chisel shank.

12. The chisel according to claim 1, wherein an outer surface of the wear-resistant layer is convexly curved along a longitudinal extent of the outer surface, or wherein the outer surface is concavely curved along a longitudinal extent of the outer surface, or wherein the outer surface has alternating concavely curved and convexly curved sections along the longitudinal extent of the outer surface.

13. The chisel according to claim 1, wherein an internal angle is formed between a surface of the cutting element and an outer surface of the wear-resistant layer at a transition thereof.

14. A chisel comprising a chisel head and a chisel shank, wherein the chisel head is formed at least from a base part and from a cutting element which is connected to the base part and which is composed of a hard material, wherein the cutting element lies indirectly or directly with a bearing face at least regionally on the base part, and wherein the base part has, adjacent to the cutting element, a wear-resistant layer on an outer face of the base part, which wear-resistant layer covers at least one section, facing toward the cutting element, of the outer face of the base part, wherein the wear-resistant layer covers at least one surface section, adjacent to the bearing face, of the cutting element.

15. The chisel according to claim 14, wherein a brazed joint is formed between the wear-resistant layer and the surface section of the cutting element.

16. The chisel according to claim 14, wherein the wear-resistant layer protrudes beyond the counterpart face in a direction of a central longitudinal axis of the chisel head.

17. The chisel according to claim 1, wherein the wear-resistant layer has a varying layer thickness.

18. The chisel according to claim 14, wherein the wear-resistant layer and the counterpart face form a cup-shaped receptacle for the cutting element.

* * * * *